US010388128B2

(12) United States Patent
Murphy et al.

(10) Patent No.: US 10,388,128 B2
(45) Date of Patent: Aug. 20, 2019

(54) ALARM SYSTEM FOR A SINGLE MODE OPTICAL FIBER NETWORK

(71) Applicant: Network Integrity Systems, Inc., Hickory, NC (US)

(72) Inventors: Cary R. Murphy, Hickory, NC (US); Mark K. Bridges, Hickory, NC (US); David Thompson, Hickory, NC (US); Joseph Giovannini, Hickory, NC (US); David E. Vokey, Sidney (CA)

(73) Assignee: Network Integrity Systems, Inc., Hickory, NC (US)

( * ) Notice: Subject to any disclaimer, the term of this patent is extended or adjusted under 35 U.S.C. 154(b) by 0 days.

(21) Appl. No.: 15/643,046

(22) Filed: Jul. 6, 2017

(65) Prior Publication Data

US 2018/0033269 A1 Feb. 1, 2018

Related U.S. Application Data

(63) Continuation of application No. 14/461,575, filed on Aug. 18, 2014, now abandoned, which is a continuation-in-part of application No. 14/144,882, filed on Dec. 31, 2013, now abandoned.

(60) Provisional application No. 61/747,891, filed on Dec. 31, 2012, provisional application No. 61/881,407, filed on Sep. 23, 2013.

(51) Int. Cl.
*G08B 13/186* (2006.01)

(52) U.S. Cl.
CPC ..... *G08B 13/186* (2013.01)

(58) Field of Classification Search
CPC ..... G08B 13/02; G08B 13/18; G08B 13/186
See application file for complete search history.

(56) References Cited

U.S. PATENT DOCUMENTS 6,437,316 B1 * 8/2002 Colman ..... A61M 39/10 250/222.1
2004/0037556 A1 * 2/2004 Matz ..... H04B 10/032 398/40
2006/0280502 A1 * 12/2006 Sekine ..... H04B 10/2507 398/71
2007/0092176 A1 * 4/2007 Murphy ..... H04B 10/077 385/13
2009/0263123 A1 * 10/2009 Zhu ..... H04B 10/071 398/16
2010/0111537 A1 * 5/2010 Cheng ..... G02B 6/12004 398/82

(Continued)

*Primary Examiner* — Mina M Shalaby
(74) *Attorney, Agent, or Firm* — Adrian D. Battison; Ade & Company Inc; Kyle R Satterthwaite

(57) ABSTRACT

A method is provided for detecting intrusion into an optical cable of a single mode optical fiber network comprising where monitoring light signals are transmitted along a telecommunications optical fiber to be monitored either along a fiber additional to a data fiber or by multiplexing onto a common fiber. The received monitoring light signals after transmission along the telecommunications optical fiber are analyzed for changes indicative of movement of the optical fiber for detecting an intrusion event. The monitoring light signals at the receive end of the fiber signals are monitored by feeding the signals from the single mode fiber into a multi-mode fiber in a manner which causes changes in modal power distribution which can be detected by taking a portion only of the modes.

24 Claims, 4 Drawing Sheets

(56) References Cited

U.S. PATENT DOCUMENTS

| | | | | |
|---|---|---|---|---|
| 2010/0166172 | A1* | 7/2010 | Whaley | H04M 1/738<br>379/399.01 |
| 2011/0013904 | A1* | 1/2011 | Khermosh | G01M 11/3118<br>398/16 |
| 2011/0241881 | A1* | 10/2011 | Badinelli | G02B 6/4446<br>340/541 |
| 2014/0186040 | A1* | 7/2014 | Fujiwara | G02B 6/2808<br>398/66 |

* cited by examiner

ALARM SYSTEM FOR A SINGLE MODE OPTICAL FIBER NETWORK

This application is a continuation of application Ser. No. 14/461,575 filed Aug. 18, 2014 which is a continuation in part of application Ser. No. 14/144,882 filed Dec. 31, 2013.

This application claims the benefit under 35 USC 119 (e) of Provisional Application 61/747,891 filed Dec. 31, 2012 the disclosure of which is incorporated herein by reference.

This application claims the benefit under 35 USC 119 (e) of Provisional Application 61/881,407 filed Sep. 23, 2013 the disclosure of which is incorporated herein by reference.

This invention relates to a network alarm system utilizing a multi-mode sensing fiber.

BACKGROUND OF THE INVENTION

This application relates to alarm system manufactured by the present assignees under the trade marks Interceptor and Vanguard, details of which are available from a number of prior issued patents by the Assignees including U.S. Pat. No. 7,333,681 (Murphy) issued Feb. 19, 2008 and U.S. Pat. No. 7,092,586 which describe a system for securing multimode fibers and U.S. Pat. No. 7,142,737 (Murphy) issued Nov. 28, 2006 which describes a system for securing single mode fibers. The disclosures of each of the above patents are incorporated herein by reference.

In each of these systems, an optical signal is transmitted along a fiber and the signal received at a receiver which extracts a received signal which can have different characteristics relative to the transmitted signal due to movement of the fiber. The received signal is thus analyzed in a light signal analysis system to extract a signal indicative of any changes in characteristics of the light signal. This signal is then itself analyzed to determine whether the characteristics have changed sufficiently to indicate that a movement of the fiber indicative of an attempt to intrude into the fiber has occurred. The system further includes a control and alarm system which controls the system and an alarm in the event that an intrusion has been found.

The arrangement and location of the components can vary widely with the receiver located at the same end as the transmitter or at an opposed end. The alarm and control system can also be located at different positions in the system. Communication of data between the components can be carried out in different ways.

Many different constructions and techniques for this system are well known to persons skilled in the art and can be determined from one or more of the patents of the Assignees.

According to US Government regulations, a network carrying unencrypted classified data must be protected by a Protected Distribution System (PDS), One form of PDS is the Alarmed Carrier, which is a system by which a conveyance or carrier is alarmed by a device for detecting intrusions and attempted intrusions.

An example of an arrangement of this type is shown in U.S. Pat. No. 7,706,641 issued Apr. 27, 2010 by the present Applicants which describes in detail the monitoring system used in the present application, the disclosure of which is incorporated herein by reference. This patent describes that some or all of the optical fibers of a single-mode or multimode cable are monitored for intrusion by transmitting through the fibers a signal which can be analyzed for changes in its characteristics which are indicative of movement as a prelude to an intrusion event.

Data can be stolen from an optical fiber by removing the jacket and installing a tap device on the bare fiber, or by other methods. Optical fiber intrusion detection systems of the type described above detect when a fiber cable is being subjected to vibration, motion, or handling that would be typical of an intrusion attempt. The system reports the intrusion attempt to the cable owner so that the cable can be inspected and the threat removed.

The fiber intrusion detection system works by transmitting a monitoring signal through a fiber loop. Disturbances on the fiber cause the monitoring signal to be modulated. At the end of the loop, the modulated signal is received, digitized and processed, and alarms are raised when an intrusion is detected.

Historically, alarmed carriers required two fibers for monitoring-classically one carrying the laser signal away from the monitoring device, and one carrying the alarm signal back, these joined at the far end (known as "looping back").

A legacy optical network contained two optical fibers for data. Recent advances in technology have seen the introduction of the Passive Optical Network (PON). The PON is a system which delivers bidirectional communication over a single fiber by use of separation of send and receive by utilizing separate wavelengths.

A passive optical network (PON) is a point-to-multipoint, fiber to the premises network architecture in which unpowered optical splitters are used to enable a single optical fiber to serve multiple premises, typically in the range 16-128. A PON consists of an optical line terminal (OLT) at the service provider's central office and a number of optical network terminals (ONTs) near the end users. A PON reduces the amount of fiber and central office equipment required compared with legacy network architectures.

SUMMARY OF THE INVENTION

In a system such as that described hereinafter for a single fiber multi-drop security system, there is a source of instability caused by many optical signals of precisely the same wavelength being joined together and causing interference. Standard detection methods are problematic as the slightest disturbance to any of the fiber causes wild fluctuations in the fiber containing combined signals.

It is one object of the invention to provide an alarm system of the above type which resolves or reduces the above problem.

This invention addresses this by recognizing that these combined single mode optical signals when injected into a multimode fiber fill the multimode fiber as though they were a multimode signal, and therefore standard multimode detection methods as set out in above U.S. Pat. No. 7,333,681 or 7,092,586 can be employed.

The method used is to take the combined signals, which are traveling in a single-mode fiber and launching them into a length of multimode fiber. This new multimode signal can be monitored for moderate handling by applying standard multimode speckle detection methods, such as use of a tap coupler per our U.S. Pat. No. 7,092,586. A second detection method is to use a length of single mode fiber after the multimode as a method of detecting variations in modal distribution.

In examples, the single-mode fiber is typically 9μ in core diameter, the length of the multi-mode fiber can be of the order of 1 meter which has worked well and can have a diameter of typically either 50μ or 62.5μ.

According to the invention therefore there is provided a method for detecting intrusion into at least one optical fiber of an optical network comprising:

transmitting monitoring light signals along a telecommunications optical fiber to be monitored having a transmit end and a receive end;

and analyzing received monitoring light signals after transmission along said telecommunications optical fiber for changes in said monitoring light signals indicative of movement of said optical fiber for detecting an intrusion event;

wherein said optical fiber comprises a single mode fiber;

and wherein the light signal in the single mode fiber are analyzed by injecting the signals from the single mode fiber into a multimode fiber and analyzing changes in a signal from the multimode fiber.

Preferably the light signals are analyzed by detecting changes in modal power distribution of the signal from the single mode fiber in the multimode fiber.

Preferably the light signals are analyzed by extracting a portion of the signal which contains a portion of the modes so that the changes in modal distribution provide a change in amplitude of the portion extracted.

In one example, a tap coupler is used on the multimode fiber to extract the portion only of the signal.

In another example, the signal from the multimode fiber is injected into a single mode fiber to extract the portion only of the signal.

Thus typically the light signal in the single mode fiber is obtained from a splitter connected to multiple fibers so as to detect movement of one or more of the multiple fibers.

According to another optional aspect of the invention there is provided a method for detecting intrusion into one or more optical fibers of an optical fiber cable of the above type wherein the monitoring light signals are transmitted at the transmit end of the telecommunications optical fiber and at the receive end of said fiber the signals are returned along the same fiber.

The present arrangement where the same monitor signal is returned back into the monitored fiber from the remote end can be used with a single fiber or with a multiplex system such as a PON where the data is multiplexed onto individual fibers from a common source.

The arrangement is particularly applicable to a PON system described herein but is not limited to same. When used in the PON, the PON signal fibers and monitor fibers are concurrent in the same cable such that the monitor fiber detects any attempt to access the PON signal fiber.

Preferably the monitor system acts detecting movement of the fiber at locations along the length of the fiber.

Preferably the monitor system acts by providing at least one sensor arrangement for receiving a light signal transmitted through the fibers, detecting a series of received light signals which have been transmitted along the fibers to be monitored; comparing at least some of the received light signals relative to data obtained from previously received ones of the received light signals to detect changes in the received light signals relative to the previously received light signals; and analyzing the changes to determine any changes which are indicative of manipulation of the optical fiber causing movement of a portion thereof along the length thereof.

Preferably the monitor system acts to generate an alarm in response to the detection of any such changes which are indicative of manipulation of the optical fiber causing movement of a portion thereof along the length thereof.

In most cases the receive input and the transmit output of the monitor signals are connected into the same fiber by use of an optical coupler.

In other cases however the receive input and the transmit output of the monitor signals are connected into the same fiber by use of another device.

Preferably there is provided an optical isolator on the laser output leg to protect the signal laser from reflections.

Preferably there is provided an insensitive lead-in fiber leading to the multiplexer.

Preferably 1×2 couplers are obtained using a 2×2 coupler with the extra leg terminated where the extra leg has a low reflectance termination.

Preferably there is provided connectors on a junction box of the multiplex system which are treated with low reflectance termination such as angled connectors or index matching gel which aids in moves, additions and changes.

Preferably the fiber is non-reflective, and can be used as needed by plugging in a new fiber.

Preferably there is provided terminating connectors on the junction box of the multiplex system with low reflectance termination such as a mating connector with index matching gel or a "dog legged" non reflective fiber stub.

Preferably the PON signal and the monitor signal are located in an armored duplex zip cord so as to meet federal approval for armored cable PDS.

Preferably the PON signal and protection signal are multiplexed using WDM so SPON exists on a single fiber.

Preferably the multiplexing is performed by wavelength, utilizing an out of band laser for monitoring, coupled in through a WDM.

Preferably an unused wavelength of the PON transmitter is used as the monitor source.

Preferably the monitor signal is returned at the end user by a 1×2 coupler joining the two legs together to loopback the signal by means of splicing or mechanical connection.

Preferably there is provided a reflective optical connector to terminate the monitored fiber in the UB by way of deposited reflective material such as Au or an open air reflection.

Preferably the receive input and the transmit output of the monitor signals are connected into the same fiber by a device which is internal to the alarm unit creating a one-box solution.

Alternatively the receive input and the transmit output of the monitor signals are connected into the same fiber by a device which is external to and remote from the alarm unit.

The cables to the users can be all fiber cables or hybrid fiber/electrical.

BRIEF DESCRIPTION OF THE DRAWINGS

One embodiment of the invention will now be described in conjunction with the accompanying drawings in which.

DETAILED DESCRIPTION

Figure 1:
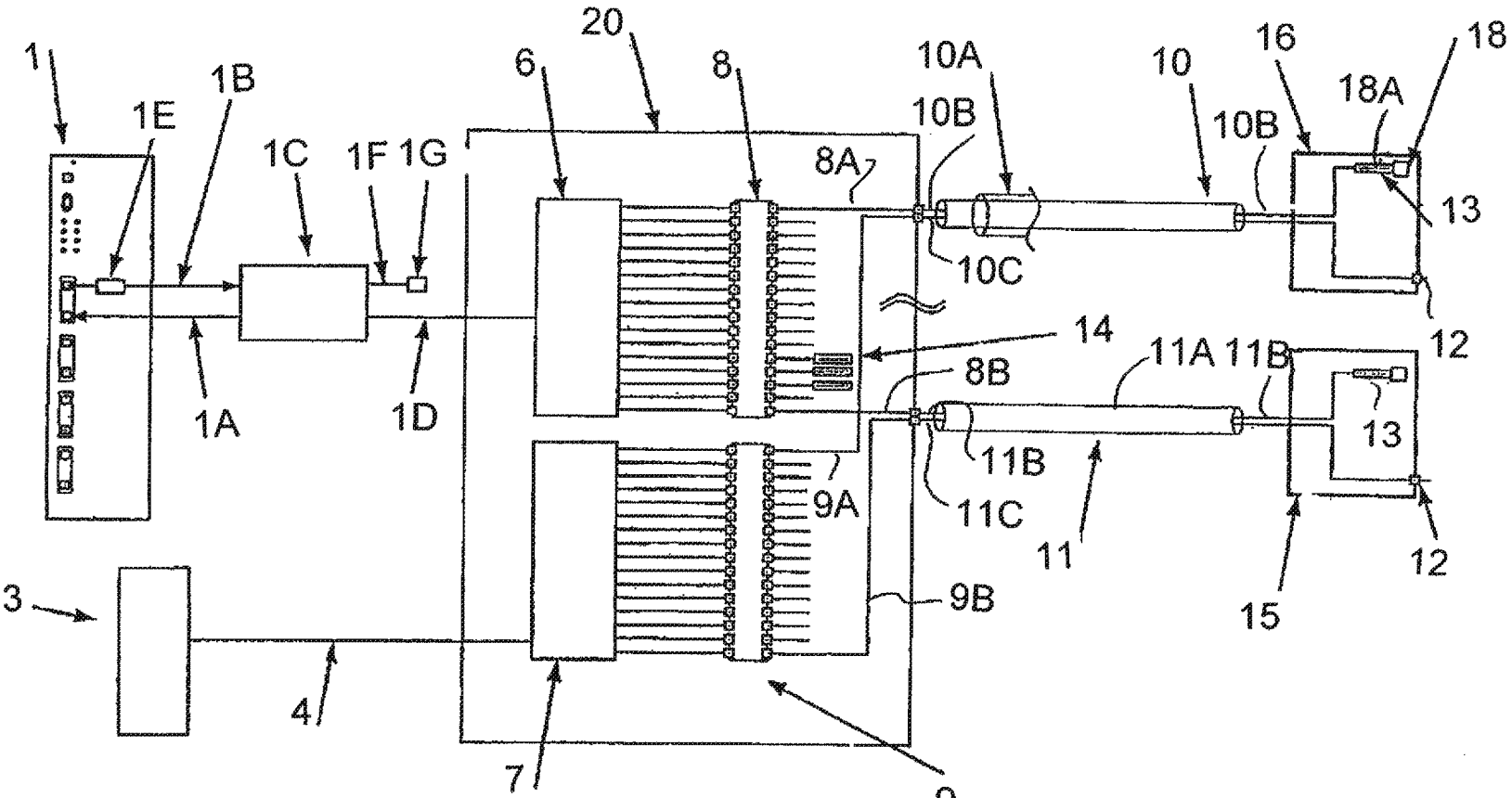
FIG. 1 is a schematic illustration of a first embodiment of the system according to the present invention.

A data source 3 provides data on an optical fiber 4 in a system such as a PON Optical Line Terminal (OLT).

An alarm unit 1 of the type defined above is provided in the apparatus for detecting intrusion and provides and receives optical monitoring light signals on transmit and receive fibers 1A, 1B through a multiplexer 1C to supply to the system and to receive from the system after passing though the fibers for detecting the indication of intrusion as previously defined.

The alarm signals are connected to the 1×2 coupler 1C. The signals from the coupler 1C are supplied on a fiber 1D to a junction box 20 including a 1×N optical splitter 6, which is typically, but not necessarily a 1×32 splitter, and which acts to connect the monitor signal from the alarm device 1 to multiple outputs. Each output containing alarm signal from the splitter 8 is supplied respectively to a monitor signal patch panel 8.

The data signals from data device 3 are connected by the fiber 4 to the junction box 20 including a 1×N optical splitter 7, which is also typically, but not necessarily a 1×32 splitter, and which acts to connect the data signal to multiple outputs. Each output containing data signals from the splitter 7 is supplied respectively to a monitor signal patch panel 9.

In FIG. 1, the splitters 6 and 7 and the patch panels 8 and 9 form part of the junction box 20. However in an alternative arrangement, there may be provided a cable delivering signals from the splitter 6, 7 to a remote location for implementations when splitters 6, 7 are in a separate location from the patch panels 8, 9.

The output from the junction box 20 is supplied on fibers 8A and 9A, 8B, 9B to fibers 10A and 10B in cable 10 and to fibers 11A and 11B in cable 11 for transmission to remote locations. Thus each of the cables 10, 11 caries combined monitor and data signals from the patch boards 8, 9 to a remote location such as a user drop box 15, 16. Thus cables 10, 11 carries combined monitor and data signals to a remote location such as a user drop box 15, 16. The cables 10 and 11 are shown as examples of a series of such cables from the separate output ports of patch boards 8, 9.

At each user's drop box 15, 16 is a connector 12 for delivering data to user equipment. There is also provided a device 13 for returning a monitor signal back to alarm unit 1. Unused ports on patch boards 8, 9 are optionally terminated by a low reflectance termination device 14. The user drop boxes 15 and 16 are conventional and allow end user to access secure network with equipment such as an ONT.

In some more complex systems there can be provided a secondary distribution box similar to the junction box 20, also known as a "Zone Box" for further distributing the data and/or monitoring to further locations.

In some cases the splitter 1C that multiplexes the transmit 1A and receive 1B of alarm signal can be mounted internally of the alarm unit 1 rather than as an external element as shown. The alarm system is arranged to include summing the receive input and the transmit output of the monitor signals such that there is a single fiber connection to the alarm monitoring equipment.

The output fibers of the alarm unit 1 are multiplexed together by the coupler 1C. Concurrently, the PON Optical Line Terminal (OLT) 3 is sending and receiving time division multiplexed data for the end users over fiber 4. The alarm signal is split by splitter 6 for feeding the ultimate end users, similarly data is split by splitter 7. These multiple signals are managed by patch boards 8, 9 feeding cables represented by 10 and 11 to the end users. There can be as many drop boxes 15, 16 as there are channels in the splitters 6, 7, and there will typically be one cable 10, 11 per box.

The termination device 14 is used for terminating unused channels of the splitters 6, 7 in a non-reflective manner. This protects the detection system from exposure to excessive reflection from unused circuits.

The device 13 acts to return the signal to the alarm unit, as shown in FIG. 1 by a loopback 18 constructed by connecting the two legs of a 1×2 coupler 18A.

Figure 2:
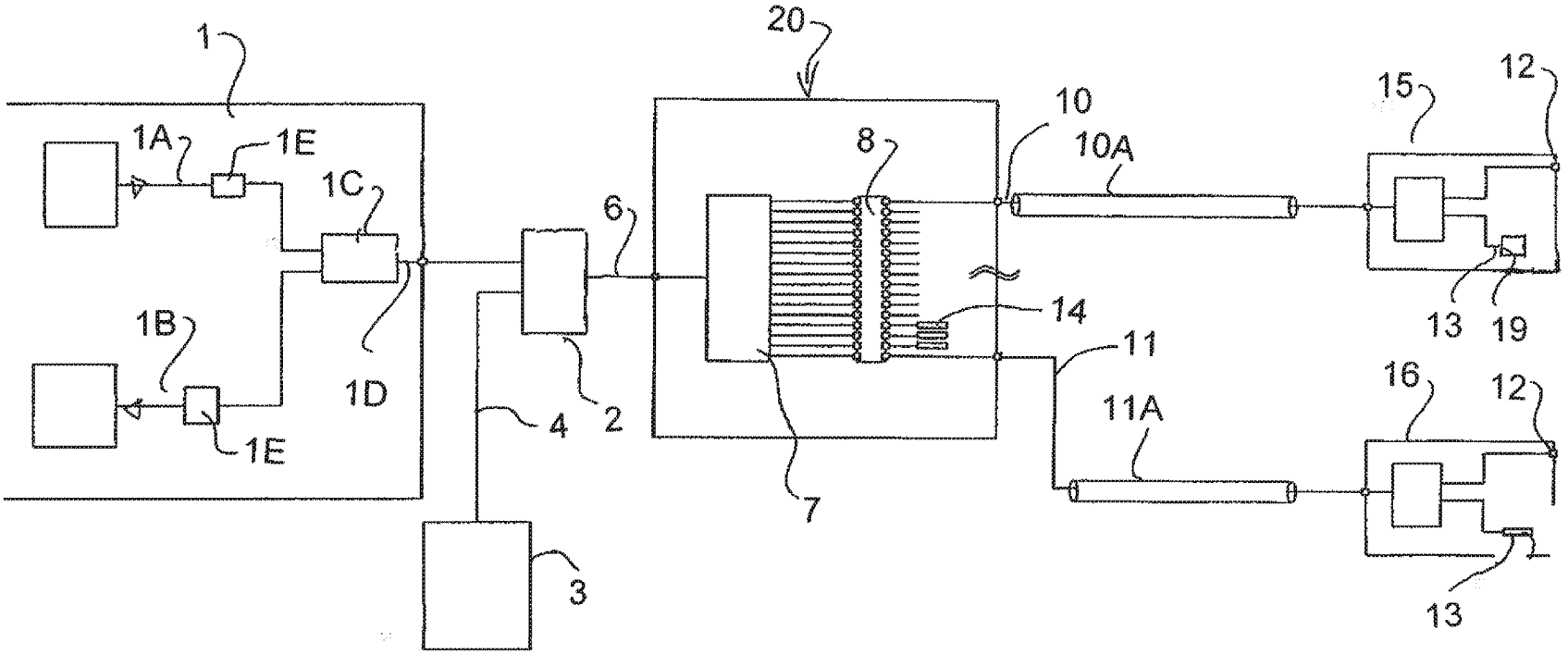
FIG. 2 is a schematic illustration of a second embodiment of the system according to the present invention.

An alternative method by which this can also be accomplished is shown in FIG. 2 by terminating or connecting the end of the monitor portion 10B of cable 10 to a reflective device 19, or depositing the reflective material directly onto the end of the fiber 10B at 19.

Other methods can also be provided such as by means of splicing or mechanical connection. This is accomplished by terminating fiber 10 with a 1×2 optical coupler at location 19. The two output legs of the coupler are optically connected to form a continuous path by methods such as fusion splicing or a mechanical splice. This arrangement feeds the monitor signal back onto the fiber, similar to the reflective method.

That is there can be provided an optical connector to terminate the monitored fiber in the UB by way of deposited reflective material such as gold or an open air reflection.

The signal at the far end can be returned by either looping it back on itself using a coupler, or by hitting a reflection and bouncing back. The easiest ways to do a reflection is either to deposit gold or other similar reflective material onto the face of the fiber or connector, and this gives a reflection of more than 90%. Alternatively it is possible to an interface with a medium of substantially different refractive index. The cheapest way of doing this is to simply have a clean connector sitting un-terminated, which gives something like a 4% reflection which may be adequate in some circumstances.

Additional implementations can include substituting additional layers of distribution by additional junction boxes for many more end users. For example, patch boards 8, 9 can feed cables to individual floors of a building. On those floors are the additional distribution boxes such as junction boxes for supplying the users in offices.

As shown, the receive input 1A and the transmit output 1B of the monitor signals from the alarm device 1 are connected into the same fiber 1D by use of the optical coupler 1C. An optical isolator 1E is provided on the laser output leg 1B to protect the signal laser from reflections. The lead-in fiber 1D leading to the multiplexer may be insensitive. or desensitised.

The coupler 1C acts as a 1×2 coupler but can be formed as a 2×2 coupler with the extra leg 1F terminated at 1G so that the extra leg has a low reflectance termination.

The termination connectors 14 on the patch board 8 of the junction box 20 are treated with low reflectance termination index matching gel which aides in moves, additions and changes. They can alternatively include a low reflectance termination such as an angled connector, or a mating connector with index matching gel or a "dog legged" non-reflective fiber stub.

The fiber is non-reflective, and can be used as needed by plugging in a new fiber. Typically when built, all of the outputs of patch board 8 are active, and any reflection causes a signal to return to monitor unit 1 which could cause a stability issue in the measurement of detection. By pre-terminating all of these sixteen outputs with index matching gel, no appreciable reflection occurs. Connectors can just be plugged unto index gel without side effect, so circuits can be added by just plugging them in.

The cables 10, 11 carrying the PON signal and the monitor signal are located in an armored duplex zip cord 10A, 11A so as to meet federal approval for armored cable PDS. Alternatively, the PON and monitoring fibers 10A, 10B and 11A and 11B can be located in other approved hardened carrier conveyances such as EMT or conduit.

Thus in the present invention, instead of transmitting up one fiber and back along another, the present arrangement uses a construction in which the signals go up and back the same fiber 10B, 11B. The receive input 1A and the transmit output 1B of the monitor signals are connected into the same fiber by the coupler 2 which can be internal to alarm unit creating a one-box solution. Or the device can be external as shown.

An alternative arrangement is shown in FIG. 2 where the PON signal from the data supply 3 and the protection signal from the unit 1 are multiplexed in a multiplexer 2 using WDM so that Secure PON (SPON) is carried on a single fiber. As described above, the multiplexing is performed by wavelength and can use as the source at the alarm unit 1 an out of band laser unused wavelength of the PON transmitter 3 for monitoring.

Figure 3:
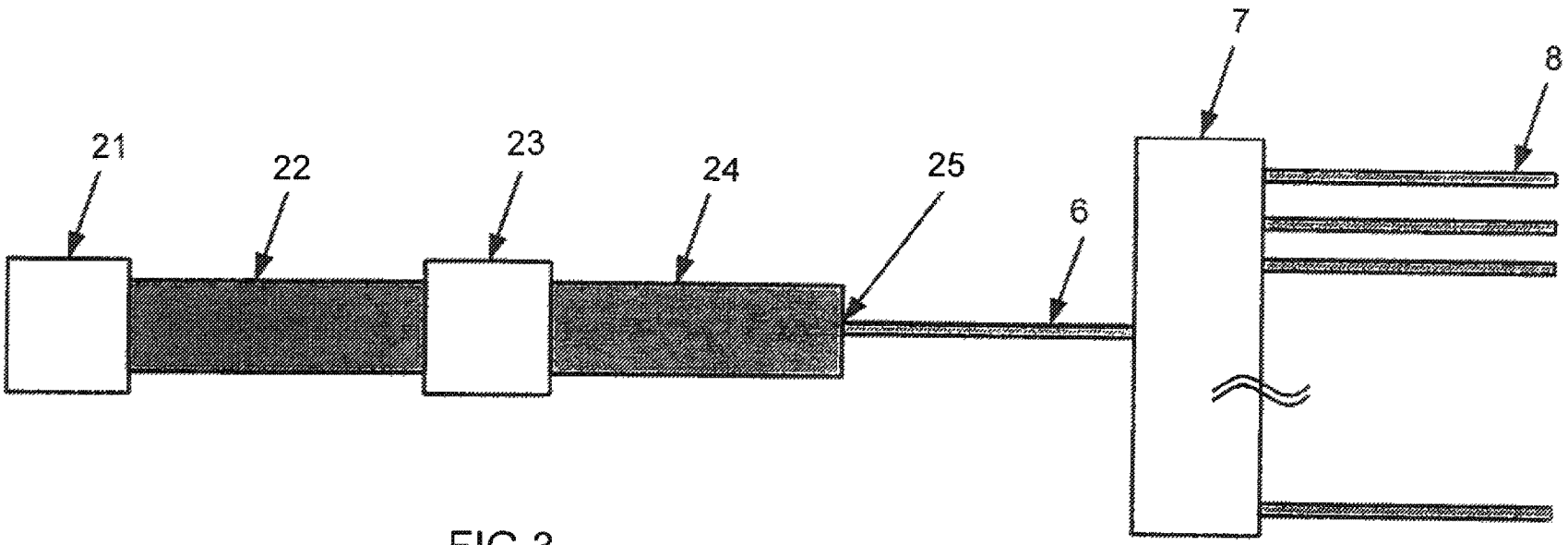
FIG. 3 is a schematic illustration of a part only of the embodiments of FIG. 1 or 2 showing a first method of analysis of the monitor signals using a multimode fiber.
Figure 4:
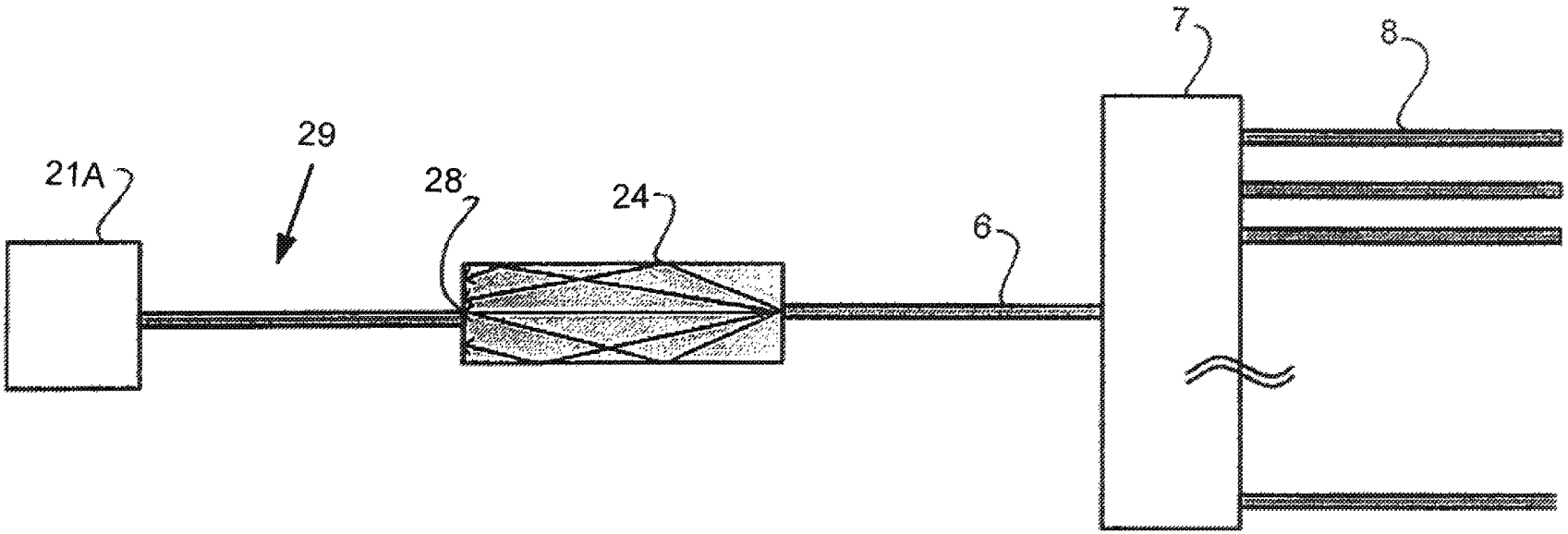
FIG. 4 is a schematic illustration of a part only of the embodiments of FIG. 1 or 2 showing a second method of analysis of the monitor signals using a multimode fiber.

FIGS. 3 and 4 show a system for overcoming a challenge in multi-drop single fiber solutions where multiple return paths of the same wavelength can cause an interferometer instability.

FIGS. 3 and 4 only show that portion of the embodiments of FIGS. 1 and 2 where the multiple return paths of single mode fibers 8 are connected to the splitter 7 onto the fiber 6 for return along the return path to the receiver for analysis. The arrangements of FIGS. 3 and 4 therefore do not use the single mode fiber analysis system described in above U.S. Pat. No. 7,142,737, but instead use an arrangement in which light from the single mode fiber 6 carrying the signal of multiple return paths 8 is connected to a length of multimode fiber 24, causing a modal distribution of the signals in that multimode fiber.

In FIG. 3, multimode fiber 24 is then coupled at a coupler 23 to multimode fiber 22, where the coupler 23 is arranged to collect only a portion of the modes, where the portion collected is arranged such that the distribution is representative of motion on one or more of the monitored fibers 8. This combines with detector 21 which analyzes the incoming portion from the coupler as the portion is changed as a system of detection. This is sensitive to movement in the single mode fiber being monitored 8 as any motion of the fiber causes slight changes in the light and disturbs the modal distribution in the multimode portion. Detector system 21 monitors this signal as detected from 22 for variations representative of an intrusion.

The monitoring of the changes in the multimode distribution in the multimode fiber 4 is carried out using the methods disclosed in above U.S. Pat. No. 7,733,681 where the modal power distribution is analyzed to determine the changes indicative of movement of the fibers 8. The injection of the light from the single-mode fiber 6 into the multimode fiber at the injection point 25 can use the arrangement disclosed in the above patent.

A second method is disclosed in FIG. 4 which shows a system in which multimode fiber 24 is directly coupled at intersection 28 to a single mode fiber 29, which acts as a mode filter. This filtering occurs when the smaller diameter of single mode fiber 29 allows a limited distribution of modes within multimode fiber 24 to be sampled. This is sensitive to movement in the single mode fibers 8 being monitored as any motion of the fiber causes slight changes in the light path length and disturbs the modal interference pattern, and therefore the distribution in the multimode portion. Detector system 21A monitors this signal as detected from 2 for variations representative of an intrusion.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A method for detecting an intrusion attempt into a plurality of optical fibers of an optical network comprising:

transmitting monitor signals along a plurality of single mode optical fibers to be monitored having a transmit end and a receive end;

combining the signals of said plurality of fibers by a multiplexing system connected to the plurality of fibers into a combined signal on one multimode fiber;

on said combined signal from said one multimode fiber, carrying out an analysis of said combined signal to detect an intrusion attempt;

wherein the light signal in the single mode fiber are analyzed by injecting the signals from the single mode fiber into a multimode fiber and analyzing changes in a signal from the multimode fiber;

wherein the light signals are analyzed by detecting changes in modal power distribution of the signal from the single mode fiber in the multimode fiber; and wherein the received monitor signals and said analysis are arranged to detect changes in said signals when said fibers are being subjected to vibration, motion, or handling that would be typical of an intrusion attempt;

and generating an alarm in response to said changes.

2. The method according to claim 1 wherein the light signals are analyzed by extracting a portion of the signal which contains a portion of the modes so that the changes in modal distribution provide a change in amplitude of the portion extracted.

3. The method according to claim 2 wherein a tap coupler is used on the multimode fiber to extract the portion only of the signal.

4. The method according to claim 2 wherein the signal from the multimode fiber is injected into a single mode fiber to extract the portion only of the signal.

5. The method according to claim 1 wherein the multiplex system is a PON system for separating a PON signal in a multiplexing system to a plurality of fibers for supply to the multiple end users and for receiving data signals from the multiple end users multiplexed on the same fiber.

6. The method according to claim 1 including providing a lead-in fiber leading to the multiplexing system which is insensitive to the monitor signal.

7. The method according to claim 1 including treating connectors on the multiplexing system with low reflectance termination to aid in moves, additions and changes.

8. The method according to claim 1 wherein each fiber forms one data transmission fiber of an optical cable and wherein the optical cable is located in a hardened conveyance.

9. The method according to claim 1 wherein each fiber forms one data transmission fiber of an optical cable and wherein a data signal and the monitor signal are multiplexed onto the optical fiber of the cable using WDM.

10. The method according to claim 9 wherein the data signal and the monitoring light signal are multiplexed utilizing an out of band laser for the monitor signal, coupled in through a WDM.

11. The method according to claim 1 wherein the monitor signal is returned at the second user end of each respective one of at least some of the fibers by a 1×2 coupler joining two legs together to loopback the monitor signal.

12. The method according to claim 1 wherein the monitor signal is returned at the second user end of each respective one of at least some of the fibers by terminating the fiber by way of reflective material.

13. The method according to claim 1 wherein the monitor signal is returned at the second user end of each respective one of at least some of the fibers by reflection using an open air reflection.

14. A method for detecting an intrusion attempt in one or more of a plurality of optical fibers of an optical network wherein said optical network comprises:

a plurality of fibers each having a first head end and a second user end;

the second user end of at least some of said plurality of fibers being connected to respective ones of a plurality of user end terminals;

a multiplexing system for separating a data signal output at the first head end to the plurality of fibers for supply of data signals to said plurality of user end terminals;

the method comprising:

transmitting a monitor signal from the head end on at least some of the plurality of optical fibers;

wherein said monitor signal is generated by a single transmitter at the head end and separated by a multiplexing system onto said plurality of optical fibers;

at the second user end of each respective one of at least some of the fibers returning said monitor signal along said respective one of the fibers back to the head end;

at said head end, receiving said returned monitor signals on said fibers after transmission along said fibers;

at said head end combining said returned monitor signals from said fibers into a combined signal on a single fiber;

on said combined signal from said single fiber, carrying out an analysis of said combined signal to detect an intrusion attempt;

wherein the light signal in the single mode fiber are analyzed by injecting the signals from the single mode fiber into a multimode fiber and analyzing changes in a signal from the multimode fiber;

and wherein the light signals are analyzed by detecting changes in modal power distribution of the signal from the single mode fiber in the multimode fiber;

wherein the received monitor signals and said analysis are arranged to detect changes in said signals when said fibers are being subjected to vibration, motion, or handling that would be typical of an intrusion attempt;

and generating an alarm in response to said changes.

15. The method according to claim 14 wherein the multiplex system is a PON system for separating a PON signal in a multiplexing system to a plurality of fibers for supply to the multiple end users and for receiving data signals from the multiple end users multiplexed on the same fiber.

16. The method according to claim 14 including providing a lead-in fiber leading to the multiplexing system which is insensitive to the monitor signal.

17. The method according to claim 14 including treating connectors on the multiplexing system with low reflectance termination to aid in moves, additions and changes.

18. The method according to claim 14 wherein the monitor signal from the head end and the combined signals are mixed in the single fiber.

19. The method according to claim 14 wherein each fiber forms one data transmission fiber of an optical cable and wherein the optical cable is located in a hardened conveyance.

20. The method according to claim 14 wherein each fiber forms one data transmission fiber of an optical cable and wherein a data signal and the monitor signal are multiplexed onto the optical fiber of the cable using WDM.

21. The method according to claim 20 wherein the data signal and the monitoring light signal are multiplexed utilizing an out of band laser for the monitor signal, coupled in through a WDM.

22. The method according to claim 14 wherein the monitor signal is returned at the second user end of each respective one of at least some of the fibers by a 1×2 coupler joining two legs together to loopback the signal.

23. The method according to claim 14 wherein the monitor signal is returned at the second user end of each respective one of at least some of the fibers by terminating the fiber by way of reflective material.

24. The method according to claim 14 wherein the monitor signal is returned at the second user end of each respective one of at least some of the fibers by reflection using an open air reflection.

* * * * *